US010493790B2

(12) United States Patent
Cunningham

(10) Patent No.: US 10,493,790 B2
(45) Date of Patent: Dec. 3, 2019

(54) MULTIPLE COLOR MARKER

(71) Applicant: Robert Thomas Brent Cunningham, San Diego, CA (US)

(72) Inventor: Robert Thomas Brent Cunningham, San Diego, CA (US)

(73) Assignee: MOCKIT SCIENCE, LLC, Sandy, UT (US)

( * ) Notice: Subject to any disclaimer, the term of this patent is extended or adjusted under 35 U.S.C. 154(b) by 104 days.

(21) Appl. No.: 15/667,611

(22) Filed: Aug. 2, 2017

(65) Prior Publication Data

US 2019/0039404 A1 Feb. 7, 2019

(51) Int. Cl.

| | |
|---|---|
| ***B43K 8/02*** | (2006.01) |
| ***B43K 5/17*** | (2006.01) |
| ***B43K 24/10*** | (2006.01) |
| ***B43K 24/16*** | (2006.01) |

(52) U.S. Cl.

CPC ..... *B43K 8/028* (2013.01); *B43K 5/17* (2013.01); *B43K 24/10* (2013.01); *B43K 24/16* (2013.01); *B43K 24/163* (2013.01)

(58) Field of Classification Search

CPC ..... B43K 8/028; B43K 5/17; B43K 24/10; B43K 24/00; B43K 24/02; B43K 24/08; B43K 24/082; B43K 24/084; B43K 24/086; B43K 24/088; B43K 24/12; B43K 24/14; B43K 24/146; B43K 24/16; B43K 24/163

See application file for complete search history.

(56) References Cited

U.S. PATENT DOCUMENTS 3,301,221 A * 1/1967 Von Arx Marcel ..... B43K 24/163 401/31

4,269,525 A * 5/1981 Melikian ..... B43K 8/003 401/108

5,022,773 A * 6/1991 Waldinger ..... B43K 5/17 401/107

5,599,122 A * 2/1997 Yu ..... B43K 24/12 401/31

* cited by examiner

*Primary Examiner* — David J Walczak

(57) ABSTRACT

Provided herewith is a marker that has multiple colors and retracts and seals the ink reservoirs. Also provided is a method of selecting a color.

3 Claims, 4 Drawing Sheets

MULTIPLE COLOR MARKER

The present application claims priority to the earlier filed provisional application having Ser. No. 62/370,166, and hereby incorporates subject matter of the provisional application in its entirety.

FIELD

The present disclosure relates generally to a writing utensil with multiple writing tips that may be retracted into the body, and more particularly to valves that store the writing tips when the tips are retracted into the body.

BACKGROUND

This disclosure relates to an apparatus and a method for a writing utensil. Specifically, this relates to markers.

Typical markers and retractable tip markers present the problem of requiring multiple writing instruments for multiple, separate colors. This problem can limit the application and usefulness of these types of markers to easily communicate via drawing or writing. Transitioning from one color marker to the next requires at least two separate actions: capping the current color marker, then uncapping the next color marker. In addition, if it is desired to draw or write with different colors, multiple markers are required in order to accurately represent the medium in question.

SUMMARY

One aspect provided herewith is a marker that allows the user to switch between different colors efficiently and prevent nib dry out. The marker comprises a main body that easily fits in a hand and houses the internal components; one or more nibs; one or more ink reservoirs; a slit valve that seals the marker nib(s) to prevent dry out; a lobe seal with one or more inner seals; one or more selector actuators to extend or retract the desired marker color; one or more spring to provide retraction force; and a housing component that retains the internal components.

Also provided is a method of switching from one color marker to the next. The method comprises using the above marker to quickly change from one marker color to a different color by use of the selector actuators.

Also provided is a method of replacing one or more colors in the above marker. The method comprised using the above marker to replace a colored marker with a different color or the same color refill by use of removal and replacement of an actuator, nib, and ink reservoir assembly.

Figure 1:
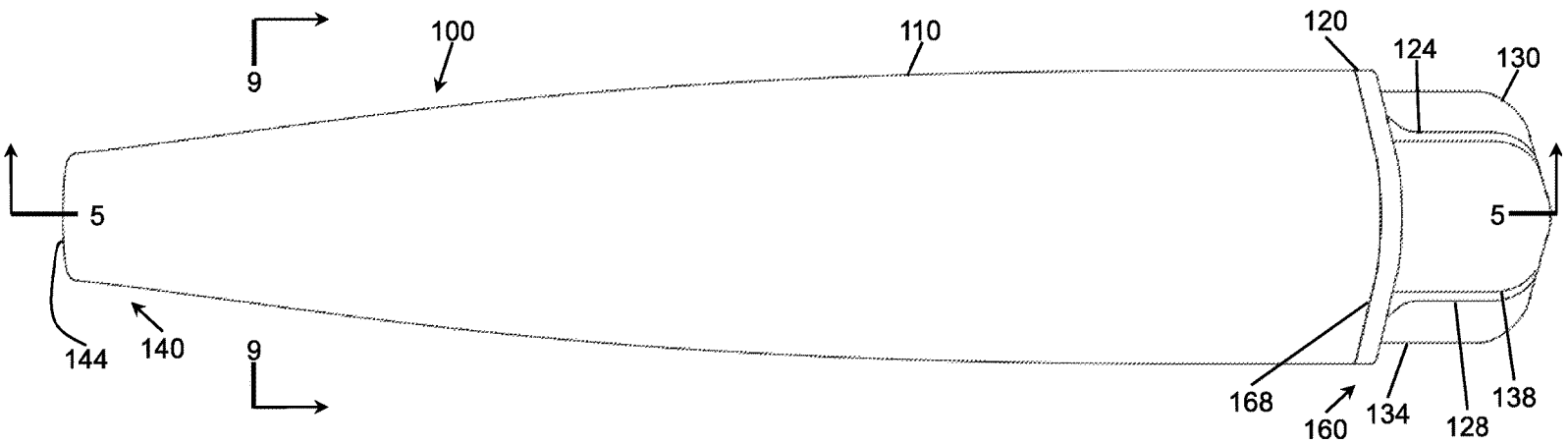
FIG. 1 is perspective side view of a retractable multiple tip marker with the tips in a retracted position.

While the devices and methods described herein are susceptible to various modifications and alternative constructions, certain illustrative embodiments have been shown in the drawings and will be described below in detail. It should be understood, however, that there is no intention to limit the disclosure to the specific embodiments disclosed. On the contrary, the intention is to cover all modifications, alternative constructions, and equivalents falling within the spirit and scope of the disclosure.

DETAILED DESCRIPTION

As used herein, the singular forms "a", "an" and "the" are intended to include the plural forms as well, unless the context clearly indicates otherwise. Additionally, the use of "or" is intended to include "and/or", unless the context clearly indicates otherwise.

Figure 2:
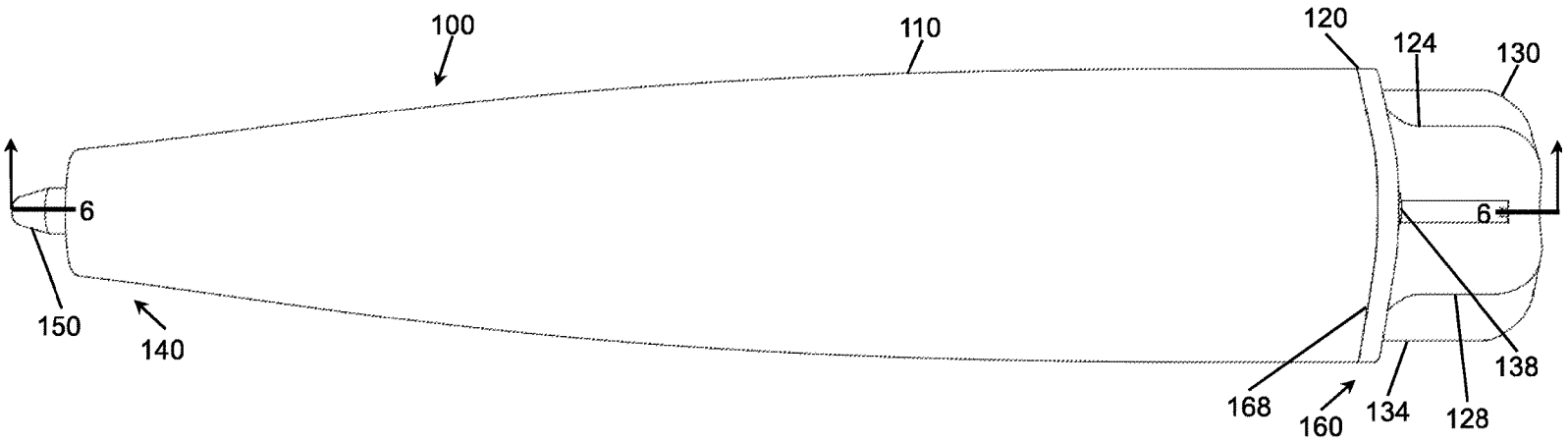
FIG. 2 is a perspective side view of the retractable multiple tip maker of FIG. 1 with one of the tips in an extended writing position.

Referring now to FIGS. 1 and 2 of the drawings, a marker 100 with a writing end 140 and an actuation end 160 is shown. The marker 100 includes a body 110 and actuators 130, 134, and 138. As shown, the body 110 includes a frame 120 that can be secured or snap fit together at a joint 168. The frame 120 includes frame ribs 124 and 128. The body 110 includes an opening 144 at the writing end 140 through which a writing tip nib 150 can extend and retract between a retracted position as shown in FIG. 1 and a writing position as shown in FIG. 2. The actuators 130, 134, and 138 are disposed through the frame 120 and frame ribs 124 and 128 in the actuation end 160. The user depresses and the actuators 130, 134, and 138 to alternate the marker 100 between the writing positions and the retracted positions.

Figure 3:
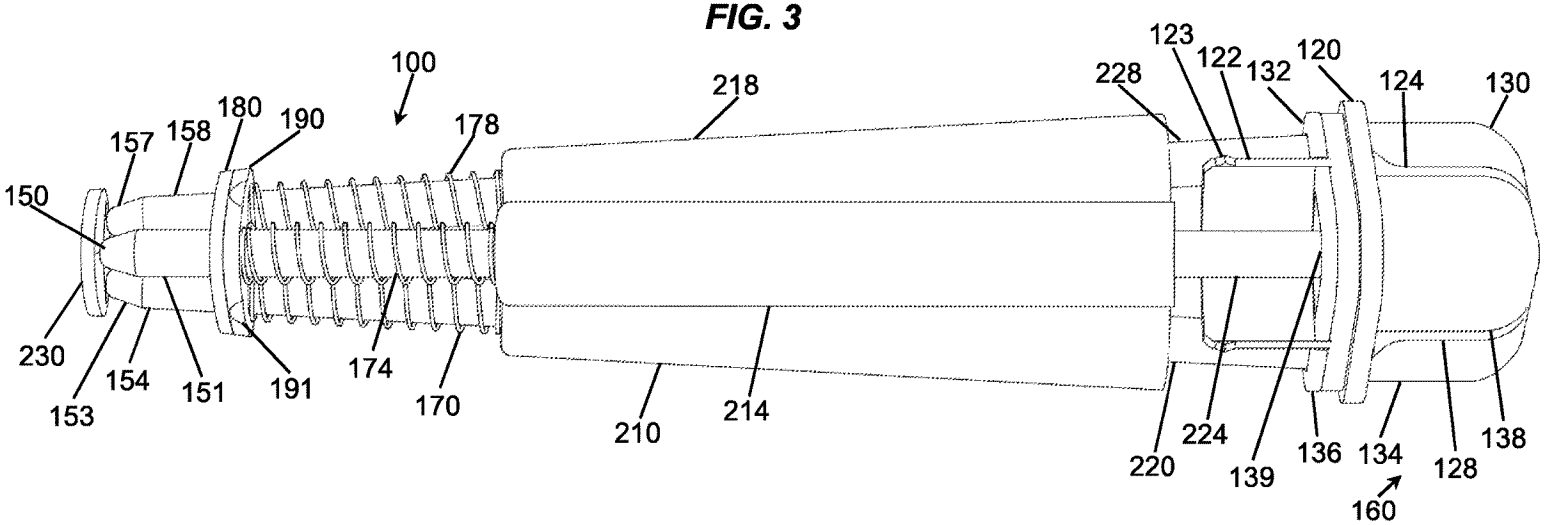
FIG. 3 is a perspective side view of the retractable multiple tip marker of FIG. 1 with the tips in a retracted position. The marker body is not shown for clarity.
Figure 4:
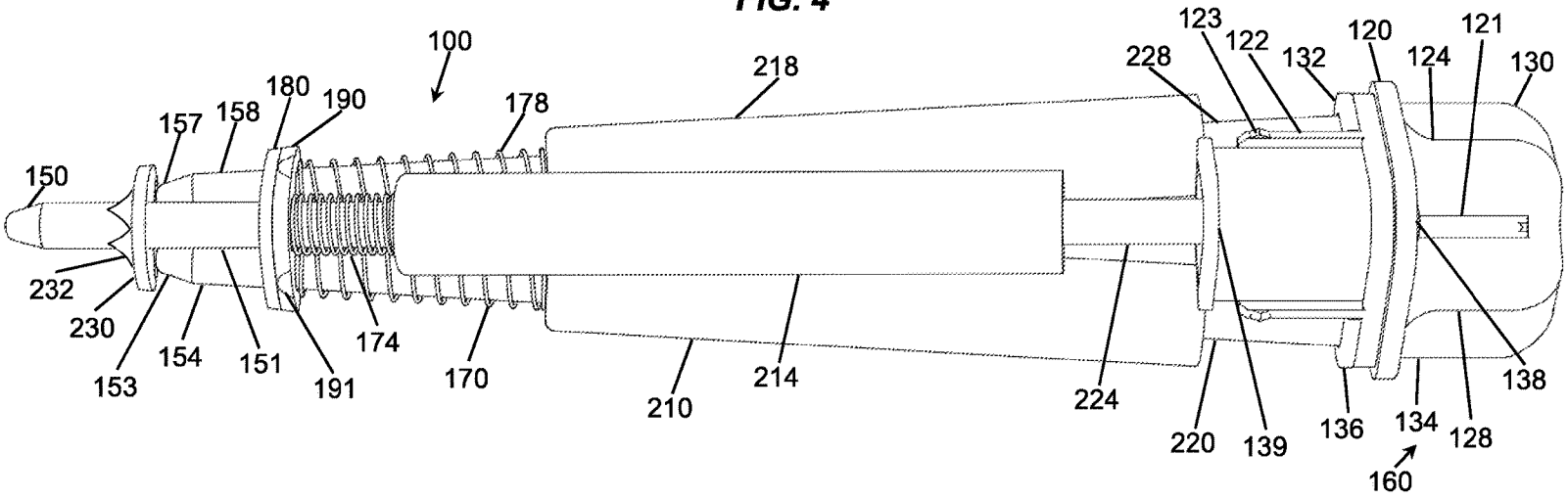
FIG. 4 is a perspective side view of the retractable multiple tip marker of FIG. 2 with one of the tips in an extended writing position. The marker body is not shown for clarity.

Referring now to FIGS. 3 and 4, a side view of the marker 100 is shown with the body 110 hidden from the view for clarity. FIG. 3 depicts the retracted position, while FIG. 4 depicts an extended writing position. Disposed within the marker 100 are a slit valve 230, nibs 150, 153, and 157, and tubes 151, 154, and 158. The tubes 151, 154, and 158 surround the nibs 150, 153, and 157. FIG. 4 depicts the slit valve 230 in an open state with tube 151 passing through it and slit valve flaps 232 in an open state. The tubes 151, 154, and 158 pass through a lobe seal 180 and platform 190. Springs 170, 174, and 178 surround the tubes 151, 154, and 158 and are captured by the platform 190 on a first end and the reservoirs bodies 210, 214, and 218 on the second end. The platform 190 includes a hook feature 191 to securely attach to the body 110. The body 110 includes an undercut feature 192 to receive the hook feature 191. Tubes 151, 154, and 158 are securely attached to reservoir bodies 210, 214, and 218. Reservoir bodies 210, 214, and 218 are securely attached to shafts 220, 224, and 228. Shafts 220, 224, and 228 are freely surrounded by and bare against actuators 130, 134, and 138 in the actuation end 160. Actuators 130, 134, and 138 include shoulders 132, 136, and 139 that bear against the frame 120. Actuators 130, 134, and 138 bear against frame ribs 124 and 128. The frame 120 includes a lower rib 122 that includes snap-fit features 123 to attach to the body 110 in FIG. 1. The frame 120 includes an upper slot 121 for the actuators 130, 134, and 138 to slide in a linear manner in the direction of the length of the upper slot 121. The slit valve 230 is shiftable from a closed position shown in FIG. 3 to an open position shown including a first nib 150 and a first tube 151 protrude through the slit valve 230 in FIG. 4.

Figure 5:
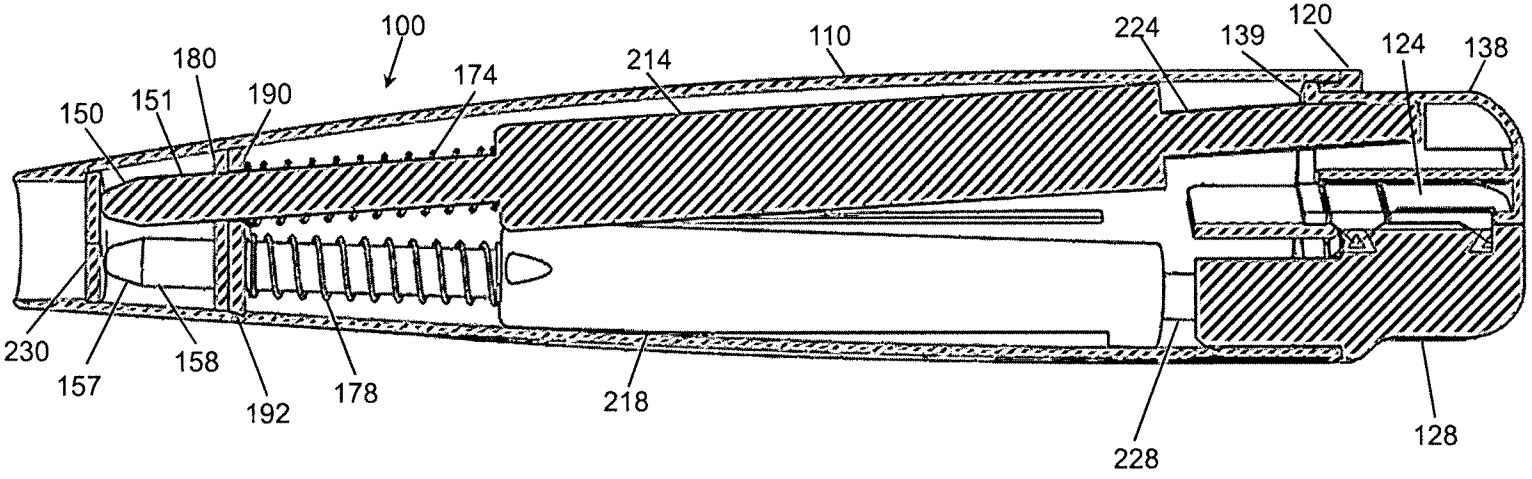
FIG. 5 is a cross-sectional view of the retractable multiple tip maker of FIG. 1, taken along line 5-5 in FIG. 1, with the marker in the retracted position.
Figure 6:
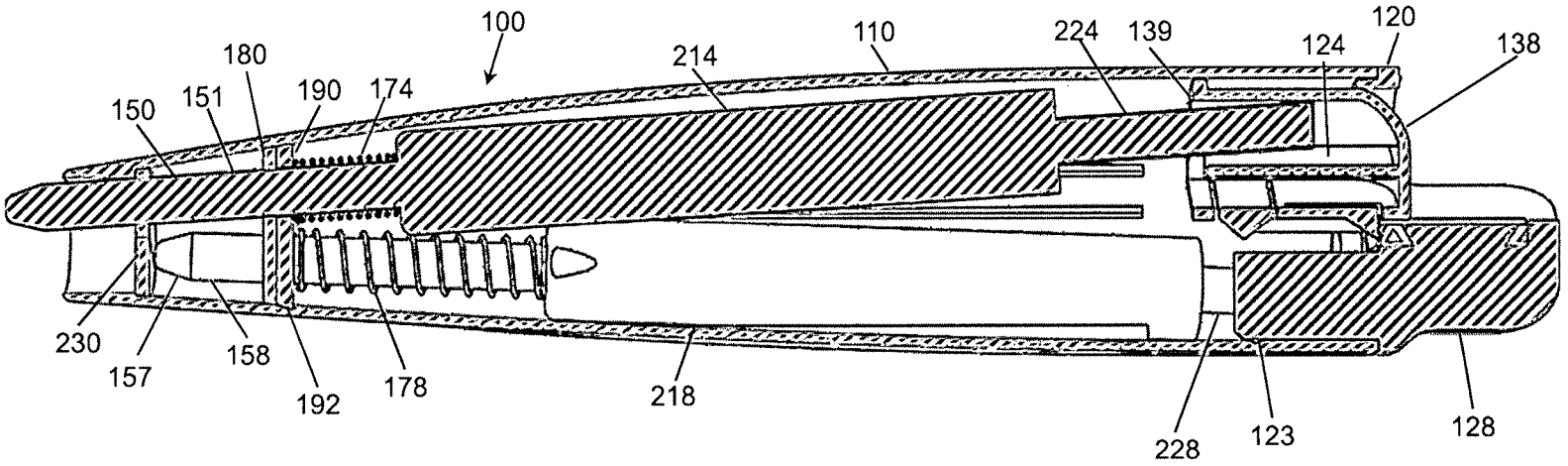
FIG. 6 is a cross-sectional view of the retractable multiple tip marker of FIG. 2, taken along line 6-6 in FIG. 2, with the marker in the extended writing position.

Referring now to FIGS. 5 and 6, section views 5-5 from FIGS. 1 and 6-6 from FIG. 2 of the marker 100 are shown. FIG. 5 depicts the retracted position, while FIG. 6 depicts a writing position. The marker body 110 is securely attached to the slit valve 230. The marker body 110 is securely attached to the platform 190. The platform 190 is securely attached to the lobe seal 180. The actuators 130, 134, and 138 include shoulders 132, 136, and 139 that bear against the body 110. The frame 120 includes a lower rib 122 that includes snap-fit features 123 to attach to the body 110.

Figure 8:
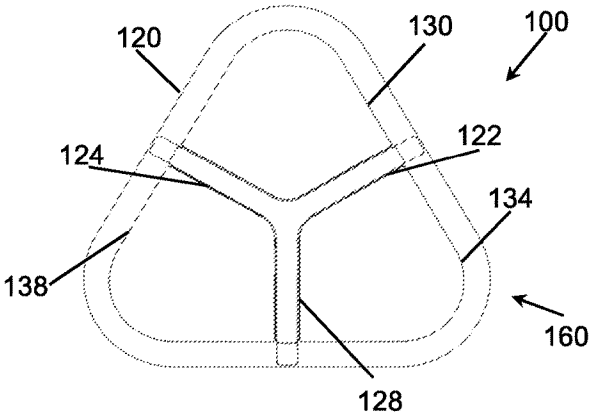
FIG. 8 is a top side view of the retractable multiple tip marker of FIG. 1.
Figure 7:
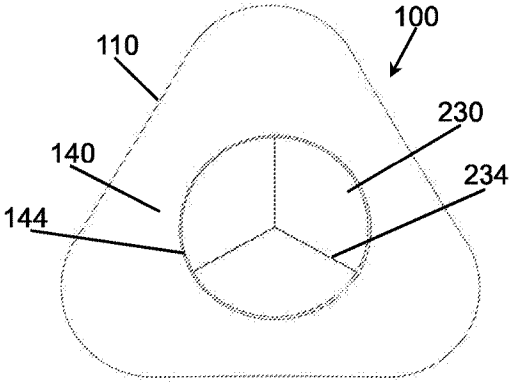
FIG. 7 is a bottom side view of the retractable multiple tip marker of FIG. 1.

Referring now to FIGS. 7 and 8 of the drawings, top and bottom views of the marker 100 with the writing end 140 and an actuation end 160 are shown. The marker 100 includes a body 110 and the actuators 130, 134, and 138. As shown, the marker 100 includes a frame 120. The frame 120 includes frame ribs 122, 124, and 128. The body 110 includes an opening 144 at the writing end 140. The actuators 130, 134, and 138 are disposed through the frame 120 and frame ribs 122, 124, and 128 in the actuation end 160. The slit valve 230 includes slits 234. In one embodiment, the slit valve 230 as shown in FIG. 7 contains slits 234 in the shape of three equally spaces slits. In other embodiments, the slit valve 230 contains slits 234 in the shape of a single straight line slit, equally spaced lines or cross shape, and more than four equally spaced slits. The slits 234 are sufficiently thin to maintain an air tight seal.

Figure 9:
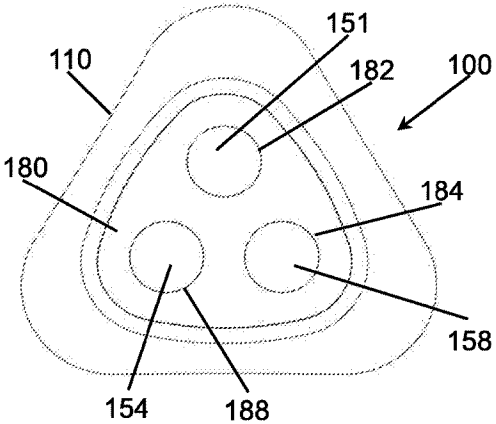
FIG. 9 is a cross-sectional view of the retractable multiple tip maker of FIG. 1, taken along line 9-9 in FIG. 1, with the marker in the retracted position.

Referring now to FIG. 9, a section view 9-9 from FIG. 1 of the marker 100 is shown. The marker body 110 is circumferentially sealed to the lobe seal 180. The lobe seal includes inner lobe seals 182, 184, and 188 to allow the tubes 151, 154, and 158 to pass through. The inner lobe seals 182, 184, and 188 circumferentially seal around the tubes 151, 154, and 158.

Figure 10:
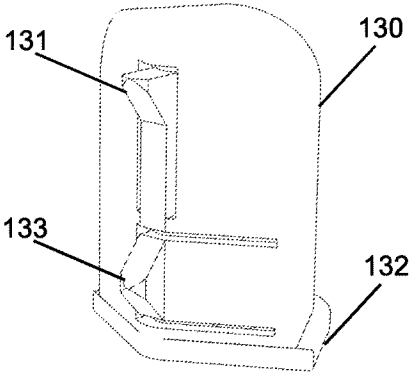
FIG. 10 is an isometric view of an actuator as shown in FIG. 1.

Referring now to FIG. 10, an isometric view of one of the actuators 130 is shown. The actuator 130 includes snap hook upper 131 and snap hook lower 133 flexibly attached to the actuator 130. The actuator shoulder 132 is also shown.

The nibs 150, 153, and 157 extend from the writing end 140 back through the tubes 151, 154, and 158 to the reservoir bodies 210, 214, 218 such that they are disposed to permit transport of ink stored in the reservoir bodies 210, 214, 218 to the writing end 140. The nib tubes 151, 154, and 158 can be made of metal or plastic and provides strength to the nibs 150, 153, and 157 such that they do not buckle when a user applies pressure during writing. The nib tubes 151, 154, and 158 further seal the ink between the nibs 150, 153, and 157 and the reservoir bodies 210, 214, 218. The reservoir bodies 210, 214, 218 in this example are a conventional capillary reservoir. A free ink reservoir with a capillary buffer to store the excess ink could also be used. The nibs 150, 153, and 157 can be an extruded plastic tube with a single channel extending the length of the nibs 150, 153, and 157. Such nibs can be made from a homopolymer or a copolymer, and more specifically, a polyacetal homopolymer or a polyacetal copolymer. A nib porosity of greater than about 15% has been found to be effective. A nib porosity of greater than about 25% is advantageous. Alternatively, the valve could be used in combination with fibrous nibs comprising nylon, acrylic, or polyester fibers.

The springs 170, 174, and 178 bias the reservoir bodies 210, 214, and 218 away from the platform 190. Under the biasing force of the springs 170, 174, and 178, which pushes reservoir bodies 210, 214, and 218 toward the actuation end 160, the slit valve 230 remains closed as shown in FIG. 3 and creates a substantially air tight seal.

The frame 120, actuators 130, 134, and 138, and shafts 220, 224, 228, when coupled as shown in FIGS. 5 and 6, provide a well-known 'selector-type' of writing utensil actuation system. As is known, by pressing a first one of the actuators 130, 134, or 138, the actuating system alternatingly places one of the nibs 150, 153, or 157 in the writing position shown in FIGS. 2, 4, and 6. By partially pressing a second one of the actuators 130, 134, or 138 the actuating system places a first one of the nibs 150, 153, or 157 in the retracted position. By fully depressing the second one of the actuators 130, 134, or 138 the actuating system places a second one of the nibs 150, 153, or 157 in the writing position. While a 'selector-type' actuator is shown herein, other types of actuator systems can be employed. For example, a twist-type actuator can be used. In this embodiment, the user twists the frame 120 relative to the body 110 to actuate the nibs 150, 153, or 157. Also for example, a 'knock-type' actuator can be used. In this 'knock-type' actuator, a user repeatedly presses the actuator to alternate between that extended writing position and the retracted position.

In the writing position shown in FIG. 2, a user has activated the actuation system to push the shaft 224, reservoir 214, tube 151, and nib 150 toward the writing end 140 of the marker 100 by extending through the slit valve 230. In the retracted position, the nibs 150, 153, and 157 remain in an air tight volume created by the slit valve 230, body 110, and lobe seal 180. In one embodiment, the location of the slit valve is proximal to the writing end opening 144. In another more preferred embodiment as shown in FIG. 5, the slit valve location is a distance from the opening 144 to protect the valve. In one embodiment, the lobe seal 180 is a distance from the slit valve 230 as shown in FIG. 5. In another embodiment, the lobe seal 180 is proximal to the slit valve 230 to minimize the air-tight volume to decrease nib dry out.

Additionally, the slit valve 230 can be used in combination with otherwise conventional ball point pens.

The lobe seal 180 is made from a material and the platform 190 is made from a different material. The lobe seal 180 material forms an air-tight seal with the body 110, and the platform 190 material forms a structural support for the lobe seal 180. The platform 190 structurally attaches to the body 110 by means of a hook feature 191. The platform 190 and lobe seal 180 are inserted into the body 110 on the actuator end and the hook feature 191 snaps into the undercut feature 192 in body 110.

As explained in further detail below, however, the material construction of these components may be varied in accordance with the teachings of the present disclosure.

The slit valve 230 can be manufactured in a two-step injection molding process, also known as two-shot molding or over molding. In a first step, the body 110 can be injection-molded to form the components that support the slit valve 230. Then the slit valve 230 material can be injection molded into the body 110. This sequence of the flow of the first material 110 during injection is but one example, and other sequences could also be used. This sequence of injection molding creates an air tight seal and structural attachment between the slit valve 230 and the body 110.

The combination of two materials allows advantageous properties of each material to be used in the slit valve 230 and in the body 110.

The body 110 can be a relatively hard thermoplastic material such as polypropylene (PP), and the slit valve 230 material can be a flexible polymer such as liquid silicone rubber (LSR), thermoplastic vulcanizate (TPV), or thermoplastic elastomer (TPE). Because PP, LSR, TPV and TPE can take many chemical formulations, the two ultimately selected materials should be chemically compatible such that they are able to be molded into a single part on a single molding press. The body 110 material should provide moldability, vapor barrier properties, and low cost. The slit valve 230 material should have compatibility with the body 110 material to ensure a good bond between the two during the molding process, high lubricity to minimize dynamic friction, and a durometer in the range of about 20 A-40 A, preferably 25 A-35 A, or more preferably about 30 A to provide structural stability while being soft enough to provide effective seals. Other thermoplastic materials may also be used for the body 110 material, including polyethylene, HDPE, Nylon, PVC, etc., provided that they satisfy the necessary moldability, vapor barrier properties, and cost considerations. A variety of LSR's, TPE's and TPV's can be used for the slit valve 230 material, provided that they satisfy the necessary molding and sealing characteristics.

The lobe seal 180 can also be manufactured in a two-step injection molding process, also known as two-shot molding or over molding. In a first step, the platform 190 can be injection-molded to form the components that support the lobe seal 180. Then the lobe seal 180 material can be injection molded into the platform 190. This sequence of the flow of the platform 190 during injection is but one example, and other sequences could also be used. This sequence of injection molding creates an air tight seal and structural attachment between the lobe seal 180 and the platform 190.

The combination of two materials allows advantageous properties of each material to be used in the lobe seal 180 and in the platform 190.

The platform 190 can be a relatively hard thermoplastic material such as polypropylene (PP), and the lobe seal 180 material can be a flexible polymer such as liquid silicone rubber (LSR), thermoplastic vulcanizate (TPV), or thermoplastic elastomer (TPE). Because PP, LSR, TPV and TPE can take many chemical formulations, the two ultimately selected materials should be chemically compatible such that they are able to be molded into a single part on a single molding press. The platform 190 material should provide moldability and low cost. The lobe seal 180 material should have compatibility with the platform 190 material to ensure a good bond between the two during the molding process, high lubricity to minimize dynamic friction, and a durometer in the range of about 20 A-40 A, preferably 25 A-35 A, or more preferably about 30 A to provide structural stability while being soft enough to provide effective seals. Other thermoplastic materials may also be used for the platform 190 material, including polyethylene, ABS, HDPE, Nylon, PVC, etc., provided that they satisfy the necessary moldability, vapor barrier properties, and cost considerations. A variety of LSR's, TPE's and TPV's can be used for the lobe seal 180 material, provided that they satisfy the necessary molding and sealing characteristics.

In a multiple color marker writing instrument, the marker provides options to a user for writing in different colors. In one embodiment, a marker contains one or more colors contained within one housing. Advantageously, a marker capable of housing more than one color will allow a user to operate the marker by conveniently switching between the desired color. In addition, an apparatus implementing principles of the present disclosure will be capable of housing markers without causing dry-out of the ink.

The embodiment disclosed herein depicts a marker 100 containing three nibs 150, 143, and 157. In some embodiments the marker 100 can contain one or more, for example, 1, 2, 4, 5, or any other desired number of nibs.

Furthermore, the embodiment disclosed herein depicts the slit valve 230 in use with a marker 100. Those of skill in the art will see that the disclosed slit valve 230 can be used in other writing utensils, such as ball point pens, styluses, pencils, highlighters, permanent markers, dry erase markers, and paint pens. Further, the disclosed slit valve 230 may prove useful in correction fluid dispensers, adhesive dispensers, paint applicators, and other products completely outside of the writing implement field.

As various changes could be made in the above methods and compositions without departing from the scope of the present disclosure, it is intended that all matter contained in the above description and shown in the accompanying drawings shall be interpreted as illustrative and not in a limiting sense.

All references cited in this specification are hereby incorporated by reference. The discussion of the references herein is intended merely to summarize the assertions made by the authors and no admission is made that any reference constitutes prior art. Applicants reserve the right to challenge the accuracy and pertinence of the cited references.

The invention claimed is:

1. A retractable marker comprising:

a housing having first and second ends, a first opening on the first end and a second opening on the second end;

a plurality of reservoir bodies positioned in the housing, each of the reservoir bodies having a tube extending therefrom and a writing nib extending from the tube;

a slit valve made from a flexible polymer positioned at the first opening of the housing;

a lobe seal made from a flexible polymer positioned in the housing spaced from the slit valve such that a chamber is formed between the lobe seal and the slit valve, the lobe seal have a plurality of inner lobe seals wherein each inner lobe seal sealing receives one of the respective tubes therethrough such that the writing nib on the respective tube is positioned within the chamber between the slit valve and the lobe seal in an airtight manner when in a retracted position;

a platform made from a relatively hard material positioned adjacent the lobe seal, the platform having a plurality of openings which align with the plurality of inner lobe seals such that each tube passes through a respective one of the openings; and an actuation system positioned at the second opening of the housing, the actuation system selectively actuating one of the reservoir bodies to enable the writing nib on the selected reservoir body to project from the chamber and through the slit valve to extend the writing nib to a writing position for writing and for selectively retracting the writing nib on the selected reservoir back through the slit valve and into the chamber such that the writing nib may be stored in an air tight manner when not in use.

2. The retractable marker as defined in claim 1 wherein the actuation system comprises a knock-type actuator for selectively positioning a writing nib in either the writing position or the retracted position.

3. The retractable marker as defined in claim 1 wherein the actuation system comprises a selector-type actuator for selectively positioning a writing nib in either the writing position or the retracted position.

* * * * *